United States Patent [19]

Bainer

[11] 3,991,795

[45] Nov. 16, 1976

[54] BEADLESS WOVEN STRINGER FOR A SPIRAL SLIDE FASTENER

[75] Inventor: David C. Bainer, Meadville, Pa.

[73] Assignee: Textron Inc., Providence, R.I.

[22] Filed: Apr. 16, 1975

[21] Appl. No.: 568,575

Related U.S. Application Data

[63] Continuation-in-part of Ser. No. 343,078, March 20, 1973, abandoned.

[52] U.S. Cl. ..... 139/384 B; 24/205.13 C; 24/205.16 C

[51] Int. Cl.[2] ..... D03D 3/00; A44B 19/12

[58] Field of Search ..... 139/384 B, 384 R, 11, 139/116, 35, 383, 416; 24/205.1 C, 205.13 R, 205.13 C, 205.16 R, 205.16 C

[56] References Cited

UNITED STATES PATENTS

| | | | |
|---|---|---|---|
| 2,236,033 | 5/1941 | Killmer | 139/384 B |
| 2,405,902 | 8/1946 | Poux | 139/384 B |
| 2,940,478 | 6/1960 | Hendley | 139/384 B |
| 3,454,052 | 7/1969 | Burbank | 24/205.1 C |
| 3,457,965 | 7/1969 | Burbank | 139/11 |
| 3,765,457 | 10/1973 | Glindmeyer et al. | 139/384 B |
| 3,791,417 | 2/1974 | Glindmeyer et al. | 139/11 |
| 3,951,181 | 4/1976 | Tsubata | 139/384 B |

FOREIGN PATENTS OR APPLICATIONS

| | | | |
|---|---|---|---|
| 538,883 | 4/1957 | Canada | 24/205.13 C |
| 2,023,845 | 12/1971 | Germany | 24/205.16 C |
| 1,244,677 | 7/1967 | Germany | 139/116 |
| 548,819 | 10/1942 | United Kingdom | 24/205.13 C |

*Primary Examiner*—James Kee Chi

[57] ABSTRACT

A beadless woven slide fastener has a pair of stringers each with convolutions of a coil of filamentary material attached to a woven carrier tape wherein the tape adjacent the coil is reduced in thickness to accommodate the flanges of a slider.

11 Claims, 4 Drawing Figures

BEADLESS WOVEN STRINGER FOR A SPIRAL SLIDE FASTENER

CROSS REFERENCE TO RELATED APPLICATION

This application is a continuation-in-part of my copending application Ser. No. 343,078 filed March 20, 1973, now abandoned, and which is incorporated herein by reference.

BACKGROUND OF THE INVENTION

1. Field of the Invention

The invention relates to slide fasteners and particularly to spiral slide fasteners employing interlocking coils of filamentary material woven to supporting tapes.

2. Description of Prior Art

The prior art, exemplified by U.S. Pat. Nos. 2,296,880, 2,651,330, 3,123,103, 3,143,779, 3,454,052 and 3,791,417, British Patent No. 548,819, and Canadian Patent No. 538,883, contains several spiral slide fasteners employing interlocking coils of filamentary material woven to supporting tapes. Many of the prior art fasteners employ a supporting bead formed from a plurality of longitudinally extending warp threads and one or more longitudinal cords or yarns bunched in a bundle or package with interwoven weft threads holding the coil against the bead providing support for the coil; however, the package of threads and cord or yarn results in a slide fastener which is more rigid and more expensive to manufacture, and sliders on the fasteners engage the bead or textile package resulting in more difficult operation of the slider as well as wear and failure on the threads. Prior art spiral fasteners which do not employ a bead or textile package have been subject to failure in that the coils are not satisfactorily supported by the tapes and distortion and displacement of the coil occur resulting in failure of the fastener.

U.S. Pat. Nos. 1,947,508, 2,651,092, and 2,940,478 disclose slide fasteners having tapes with rows of fastening elements secured on respective beaded edges of the tapes wherein the tapes have a reduced thickness adjacent the fastening elements.

U.S. Pat. No. 3,765,457 discloses a row of dome members in the form of a spatial meander attached to the edge of a carrying band by a weft thread woven in a plurality of warp threads.

SUMMARY OF THE INVENTION

The present invention is summarized in that a stringer for a spiral slide fastener includes a coil of filamentary material forming successive convolutions with locking portions joined by supporting portions, a woven tape having first and second pluralities of longitudinally extending warp threads and a plurality of transversely extending weft thread segments interwoven with the first and second pluralities of warp threads, the first plurality of warp threads having thicknesses less than a predetermined thickness and extending side by side in the tape from the coil, a plurality of weft thread loops interconnecting respective pairs of weft thread segments and extending around respective supporting portions to hold the supporting portions of the coil to the edge of the tape, and the second plurality of warp threads having thicknesses greater than the predetermined thickness and being spaced from the coil by the first plurality of warp threads.

An object of the invention is the elimination of the bead or package supporting the coil to produce a less expensive and more flexible fastener.

Another object of the invention is to support the coil in a manner to withstand lateral stresses without failure.

It is also an object of the invention to utilize a smaller slider.

A further object of the invention is to provide a slide fastener with reduced wear and tear on the threads.

It is a still further object of the invention to make a smaller fastener suitable for light duty use.

Other objects and features of the invention will become apparent from the following description of the preferred embodiment when taken in conjunction with the accompanying drawings.

DESCRIPTION OF THE PREFERRED EMBODIMENT

Figure 1:
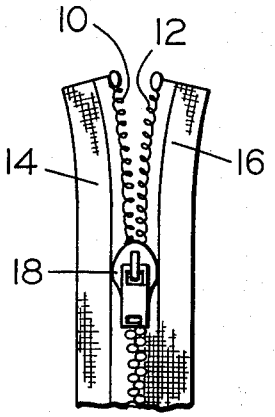
FIG. 1 is a plan view of a beadless woven spiral fastener made in accordance with the invention.

As shown in FIG. 1, a beadless woven spiral fastener has a pair of stringers with interlocking coils or spirals 10 and 12 of suitable filamentary material, such as nylon or polyester, attached to respective woven carrier tapes 14 and 16, made from conventional textile threads, and with a slider 18 for closing and opening the stringers.

Figure 2:
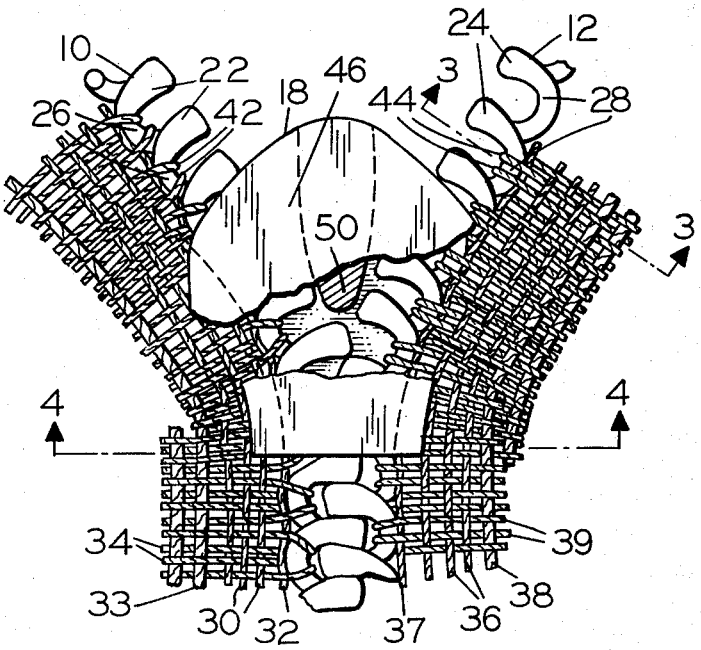
FIG. 2 is an expanded plan view, partially in cross section, of a portion of the fastener shown in FIG. 1 particularly illustrating the interconnection of woven tapes to coils.
Figure 3:
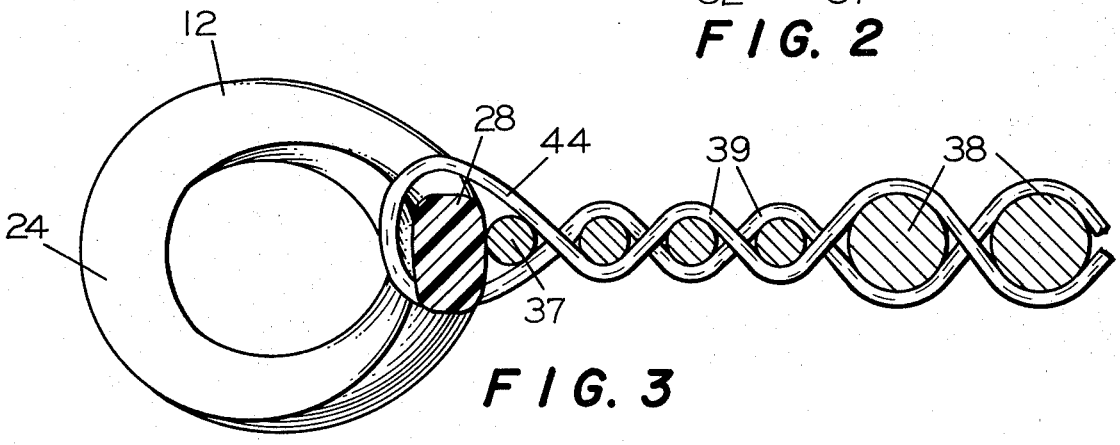
FIG. 3 is a cross-sectional view of a stringer portion of the fastener shown in FIGS. 1 and 2 along line 3—3.
Figure 4:
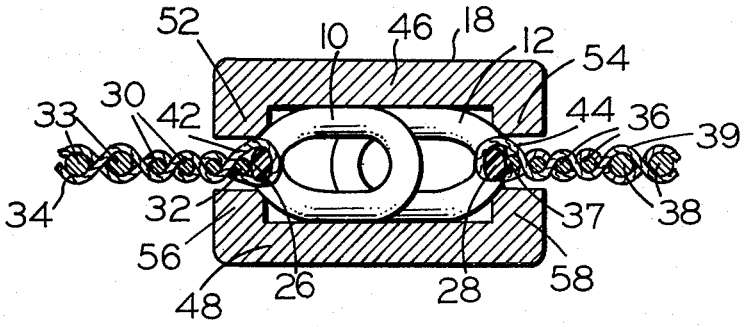
FIG. 4 is a cross-section view of a slider and interlocking coils of FIGS. 1 and 2 along line 4—4.

As illustrated in FIGS. 2, 3 and 4, the coil 10 is coiled in a clockwise direction when viewed in a longitudinal direction from the bottom toward the top of FIG. 2 while the coil 12 is coiled in a counterclockwise direction when viewed in a longitudinal direction from the bottom toward the top. Locking or head portions 22 joined by supporting portions 26 are formed on the coil 10 while locking portions 24 joined by supporting portions 28 are formed on the coil 12 in any known manner. The tape 14 has a first plurality of longitudinally extending warp threads 30 positioned side-by-side and including an edge warp thread 32 on the inner edge of the tape 16 abutting or contiguous with outward facing surface sections of the supporting portions 26. A second plurality of longitudinally extending warp threads 33 in the tape 14 are spaced from the coil 10 by the width across the first warp threads 30. Segments 34 of a weft thread extend transverse the warp threads 30 and 33 and are interwoven with the warp threads 30 and 33 to form woven tape 16. Similarly, the tape 12 has a first plurality of warp threads 36 including an edge warp thread 37, a second plurality of warp threads 38, and segments 39 of a weft thread interwoven with the warp threads 36 and 38 wherein the warp thread 37 abuts or is contiguous with outward facing surface sections of the supporting portions 28.

Loops 42 of the weft thread in the tape 14 interconnecting pairs of weft thread segments 34 encircle or extend completely around the respective supporting portions 26 and the edge warp thread 32 while loops 44 of the weft thread in the tape 16 interconnecting succeeding pairs of weft thread segments 39 encircle or extend completely around respective supporting portions 28 and the edge warp thread 37. The supporting portions 26 and 28 have substantial lengths of the filament, such lengths being substantially greater than the widths of the filament, extending along the inner edges of the tapes 14 and 16 with curved surface sections of such lengths engaged by substantial lengths or portions of the respective warp threads 32 and 37. The edge warp threads 32 and 37 are tightly held by the respective weft thread loops 42 and 44 against the curvatures of the abutted surface sections of the respective supporting portions 26 and 28.

Two weft thread loops 42 or 44 are shown securing each respective supporting portion 26 and 28 of the coils 10 and 12 to the tapes 14 and 16. More or less loops of weft thread could be employed to secure each of the supporting portions 26 and 28, however two or more loops of weft thread are preferred to securely hold the edge warp threads 32 and 37 against the abutted curved surface sections of the supporting portions. While it is preferred to have the weave of the tapes 14 and 16 designed to position the same number of weft thread loops over each of the convolutions of the coils 10 and 12, different numbers of loops can be positioned over different convolutions where the rigidity of the coils 10 and 12 and the flexibility of the threads permit.

The slider 18 includes an upper wing member 46 and a lower wing member 48 which are connected by a divider 50. As best seen in FIG. 4, the wing 46 has lateral flanges 52 and 54 extending toward respective lateral flanges 56 and 58 on the wing 48 to form a y-shaped channel for slidingly containing the coils 10 and 12. The pair of flanges 52 and 56 and the pair of flanges 54 and 58 are spaced close enough that their inner edges engage and prevent crosswise forces from pulling the respective coils from between the respective pair of flanges.

The first pluralities of warp threads 30 and 36 have thicknesses less than that thickness which would produce woven tape thicknesses equal of the spacing between the flanges on each side of the slider. The second pluralities of warp threads 33 and 38 have thicknesses selected to produce tapes 14 and 16 having sufficient strength and stability to be sewn or otherwise attached to an article and still maintain proper spacing and alignment of the locking elements of the coils 10 and 12. The number of warp threads 30 and 36 is selected to produce a width of tape having reduced tape thickness spacing the greater thickness of tape formed by warp threads 33 and 38 sufficiently from coils 10 and 12 to prevent engagement of the slider flanges on the greater thickness of tape; such width of reduced tape thickness being small enough not to substantially reduce the strength and stability of the remaining portion of the tape employing the larger warp threads 33 and 38.

The beadless woven spiral fastener is manufactured using conventional techniques employing conventional weaving apparatus with the exception that the edge warp threads 32 and 37 follow the motions of the respective coils 10 and 12. The tensioning of the weft threads is maintained at a sufficient level to ensure that the coils 10 and 12 are securely fastened to the respective edge warp threads 32 and 37 of the tapes 14 and 16. The relative looseness of the threads shown in the drawings is only for sake of clarity.

In use, the beadless woven spiral fastener is attached to an opening and the slider 18 moved to open and close the fastener at the election of the user. The flanges 52, 54, 56 and 58 engage the filament coils 10 and 12 without any substantial engagement of the weft thread segments 34 and 39, the weft loops 42 and 44 or the warp threads 30, 32, 36 and 37 insuring smooth, easy operation of the slider without any substantial wear on the threads in the tapes 14 and 16.

The relative thickness of the slide fastener carrier tapes to the size of the coils supported on the edges thereof determines the amount of support that the tapes gives to the coils, i.e., coils are supported better on relatively thicker tapes than on thinner tapes. However, with thicker tapes, the slider flanges either rub on the tapes resulting in wear and failure, or to avoid rubbing on the tapes the slider flanges are spaced wide apart which results in crosswise forces pulling the coils between the flanges. It has been discovered that relatively thick tape portions spaced from the coils by relatively thin tape portions running between the slider flanges contiguous the coils result in substantially improved support for the coils compared to thinner tapes; the relatively thin tape portions contiguous the coils allow close spacing of the slider flanges providing improved containment of the coils against crosswise forces.

The weft thread loops 42 and 44 compressing the edge warp threads 32 and 37 against substantial lengths of the supporting portions 26 and 28 of the respective coils 10 and 12 ensures that the coils are firmly held on the tapes 14 and 16. The flexible, compressible, complaint and elastic properties of the abutting edge warp threads 32 and 37 impart a certain degree of the same properties to the united or combined respective edge warp thread 32 and coil 10 and the united edge warp thread 37 and coil 12. The unions of the respective edge warp threads 32 and 37 and coils 10 and 12 become a part of the woven tapes 14 and 16 with the flexible, compressible, complaint and elastic properties ensuring that the coils 10 and 12 do not become loose and subject to failure for reasons similar to the reasons that the flexible, compressible, complaint and elastic properties of ordinary threads in a properly woven fabric ensure that the threads do not become loose.

Since many variations, modifications and changes in detail may be made in the present embodiment, it is intended that all matter contained in the foregoing description or shown on the accompanying drawings shall be interpreted as being illustrative and not in a limiting sense.

What is claimed is:

1. A beadless woven stringer for a spiral slide fastener comprising a coil of filamentary material forming successive convolutions with locking portions joined by supporting portions, a woven tape having first and second pluralities of longitudinally extending warp threads and a plurality of transversely extending weft thread segments interwoven with the first and second pluralities of warp threads, said first plurality of warp threads having thicknesses less than a predetermined thickness and extending side by side in the tape from the coil, one of said first plurality of warp threads being on the one edge of the tape and being the only warp thread in engagement with the supporting portions of succeeding convolutions of the coil, a plurality of weft thread loops interconnecting respective pairs of weft thread segments and extending completely around respective supporting portions and the one warp thread to hold the supporting portions and the one warp thread securely against each other, and said second plurality of warp threads having thicknesses greater than the predetermined thickness and being spaced from the coil by the first plurality of warp threads.

2. A stringer for a spiral slide fastener as claimed in claim 1 wherein there are at least two weft loops extending completely around the supporting portion of each convolution and the one warp thread.

3. A stringer for a spiral slide fastener as claimed in claim 2 wherein each supporting portion of the coil includes an outward facing surface section having a curvature, the two thread weft loops are spaced relative to each other about each supporting portion, and the weft thread loops hold the spaced portions of the one warp thread securely against the curvatures of the supporting portions of the coil.

4. A beadless woven spiral slide fastener comprising a pair of stringers each including a. a coil of filamentary material forming successive convolutions with locking portions joined by supporting portions, b. a woven tape having first and second pluralities of longitudinally extending warp threads and a plurality of transversely extending weft thread segments interwoven with the first and second pluralities of warp threads, c. said first plurality of warp threads having thicknesses less than a predetermined thickness and extending side by side in the tape from the coil, d. a plurality of weft threaded loops interconnecting respective pairs of weft thread segments and extending completely around respective supporting portions to hold the supporting portions of the coil to one edge of the tape, e. said second plurality of warp threads having thicknesses greater than the predetermined thickness and being spaced from the coil by the first plurality of warp threads, f. one of said first plurality of warp threads being on the one edge of the respective tape and being the only warp thread in engagement with the supporting portions of succeeding convolutions of the coil, and g. the plurality of weft thread loops extending completely around respective supporting portions and the one warp thread to hold the supporting portions and the one warp thread securely against each other; and a slider including a pair of opposite parallel wing members with flanges extending from lateral edges of the wing members toward the opposite wing members to form a Y-shaped channel for slidably containing the coils, said flanges extending over only portions of the tapes containing the first pluralities of warp threads.

5. A spiral slide fastener as claimed in claim 4 wherein each of the woven tapes has a thickness adjacent the coil substantially less than a width of each respective coil, and the flanges of the slider slidingly engage the coils.

6. A spiral slide fastener as claimed in claim 4 wherein each outward facing surface section has a curvature, at least two spaced weft thread loops of the plurality of loops extend completely around each supporting portion and the one warp thread to hold the one warp thread securely in abutment against the curvatures of the supporting portions of the coil.

7. A beadless woven stringer for a spiral slide fastener comprising a coil of filamentary material forming succeeding convolutions with locking portions joined by supporting portions', each supporting portion of the coil including an outward facing surface section having a curvature, a woven tape having a plurality of longitudinally extending warp threads positioned side by side in the tape and having a plurality of transversely extending weft thread segments interwoven with the plurality of warp threads, a plurality of weft thread loops interconnecting respective pairs of weft thread segments, one warp thread of said plurality of warp threads being on an edge of the tape and being the only warp thread contiguous with the supporting portions of the succeeding convolutions of the coil, said one warp thread between its ends having spaced portions abutting the curvatures of the outward facing sections of the supporting portions of the succeeding convolutions of the coil, and at least two weft thread loops of said plurality of weft thread loops and their respective pairs of weft thread segments extending completely around each supporting portion of said coil and their associated spaced portions of the one warp thread to hold the spaced portions of the one warp thread securely against the curvatures of the supporting portions of the coil.

8. A beadless woven stringer for a spiral slide fastener as claimed in claim 7 wherein the two weft thread loops around each supporting portion are spaced relative to each other about each supporting portion and wherein each supporting portion of said coil extends in a longitudinal direction between the ends of said coil of said stringer.

9. A spiral slide fastener comprising a pair of stringers each including as set forth in (a), (b) and (c):

a. a coil of filamentary material forming succeeding convolutions with locking portions joined by supporting portions, each one of the supporting portions including outward facing surface sections having a curvature, b. a woven tape having a plurality of longitudinally extending warp threads and a plurality of transversely extending weft thread segments, one warp thread of the plurality of warp threads being on an edge of the tape, and the one warp thread being the only warp engaging the coil and between its ends having spaced portions abutting the curvatures of the outward facing surface sections of the supporting portions of the succeeding convolutions of the coil, and c. a plurality of weft thread loops, each weft thread loop interconnecting a respective pair of weft thread segments, and at least two weft thread loops and their respective joined pairs of weft thread segments extending completely around each supporting portion of said coil and their associated spaced portions of the one warp thread to hold the spaced portions of the one warp thread securely against the curvatures of the supporting portions of the coil; and a slider including a pair of opposite and parallel wing members with lateral edges and with flanges extending from the lateral edges of the wing members, the flanges of the wing members forming a Y-shaped channel for slidably containing the coils of said pair of stringers.

10. A spiral slide fastener as claimed in claim 9 wherein each of the woven tapes of said pair of stringers has a thickness substantially less than a width of each respective coil, and wherein the flanges of the slider slidingly engage the coils.

11. A spiral slide fastener as claimed in claim 9 wherein the two weft thread loops are spaced relative to each other about each supporting portion of each convolution of the coils of both of said pair of stringers, and wherein each supporting portion of said coils of both of said pair of stringers extends in a longitudinal direction between the ends of the coils of the respective stringers.

* * * * *